United States Patent [19]

Pfaff, Jr.

[11] 4,197,154

[45] Apr. 8, 1980

[54] APPARATUS FOR APPLYING STRIP MATERIAL TO A BACKING WEB

[75] Inventor: Alan R. Pfaff, Jr., Orchard Lake, Mich.

[73] Assignee: Bernal Rotary Systems, Inc., Troy, Mich.

[21] Appl. No.: 900,495

[22] Filed: Apr. 27, 1978

[51] Int. Cl.[2] ..... H01B 13/00

[52] U.S. Cl. ..... 156/355; 83/369; 156/47; 156/361; 156/511; 156/519; 174/72 A; 174/117 F

[58] Field of Search ..... 156/353–355, 156/361, 362, 436, 464, 511, 517, 519, 520, 47, 51, 55; 428/294, 295, 458, 480; 174/117 F, 117 FF, 72 A, 72 TR; 83/360, 363, 369, 370

[56] References Cited

U.S. PATENT DOCUMENTS

| | | | |
|---|---|---|---|
| 1,876,375 | 9/1932 | Wikle | 156/517 |
| 2,029,435 | 2/1936 | Moody et al. | 156/436 |
| 2,290,386 | 7/1942 | Schindler | 156/436 |
| 3,523,844 | 8/1970 | Crimmins et al. | 156/436 |
| 3,616,066 | 10/1971 | Rainey | 156/436 |
| 4,071,393 | 1/1978 | Amphlett | 156/353 |

*Primary Examiner*—John E. Kittle
*Attorney, Agent, or Firm*—Joseph W. Farley

[57] ABSTRACT

Individual strips of material, such as copper conductors, are laminated between continuously moving webs of backing material such as mylar, in a plurality of parallel lanes extending longitudinally of the webs, by apparatus which selectively controls the length of strip material in each lane to produce a product such as a wiring harness. The apparatus includes a pressing station through which the mylar webs are continuously moved by a pair of opposed driven rollers. The strips of material are fed to the pressing station by selectively operable feeding devices, one for each lane, through selectively operable cut-off devices, one for each lane, and through a severing device selectively operable to simultaneously sever any strips in all lanes. Control means, responsive to the length of backing web moving through the apparatus, is operable to selectively regulate the operation of the feeding, cut-off and severing devices so that a desired length, or plurality of lengths, of conductor strip is applied to each lane for a given length of backing web. Each conductor strip is fed to the apparatus from an individual reel driven by a motor whose speed is controlled by the tension in the strip.

10 Claims, 10 Drawing Figures

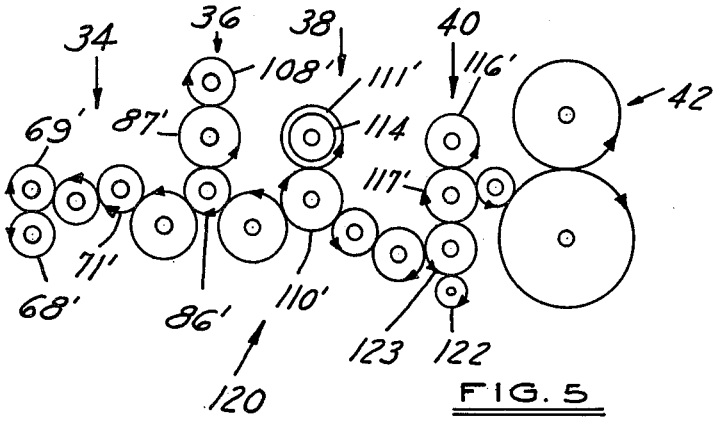
FIG. 5
FIG. 7
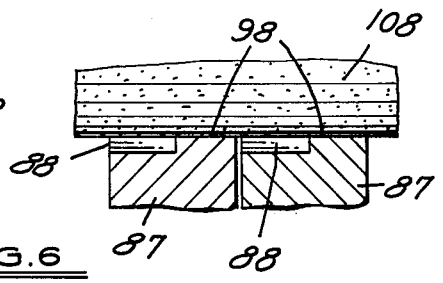
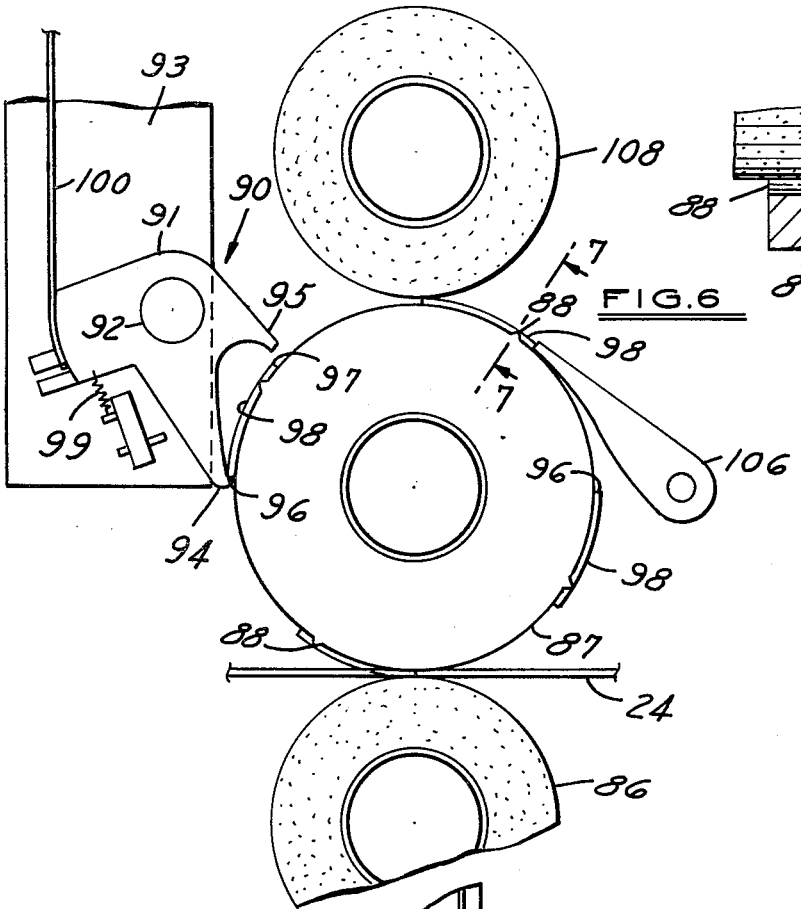
FIG. 6
FIG. 8
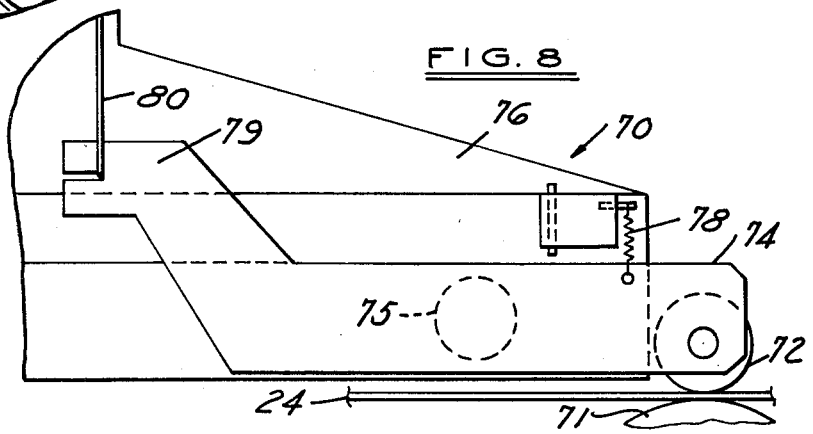

APPARATUS FOR APPLYING STRIP MATERIAL TO A BACKING WEB

This invention relates to apparatus for producing a laminar type of article havng strips of material applied to webs of backing material in parallel lanes, the length of strip material applied in each of the lanes being individually controllable so that for a given length of backing material, each lane may contain a desired length, or plurality of lengths of strip material. An example of such a product, to be described herein, is a wiring harness having a plurality of lanes of conductor strips sandwiched between webs of mylar.

The apparatus of the invention enables such a product to be continuously produced at a relatively high production rate by employing rotary components which move the backing webs through a pressing station, which selectively feeds the strip in each lane to the pressing station, which selectively cuts the strip in each lane, and which selectively severs any strips in all lanes.

To summarize the invention, apparatus is provided for applying a plurality of strips of material to a backing web in a plurality of parallel lanes spaced transversely and extending longitudinally of the backing web, the apparatus comprising a pressing station having means for continuously moving the backing web therethrough. Feeding means advance the strips of material to the pressing station for application to the backing web, said feeding means including a selectively operable feeding device for each of the parallel lanes. A selectively operable cut-off device for each of the lanes, and a severing device for all of the lanes are successively located between the feeding means and the pressing station. Control means responsive to the movement of a predetermined length of backing web through the pressing station regulates the operation of the feeding, cut-off and severing devices so that the strip material is applied to the backing web in a desired length or lengths along each of the lanes.

Each of the feeding devices comprises a driven roll engageable with one side of a strip of material, and a pressure wheel engageable with the opposite side thereof, the pressure wheel being mounted for movement toward and away from the driven roll and being connected to an actuator operable by the control means to move the pressure wheel into engagement with the strip of material. Power driven feeding rolls are provided on the upstream side of the pressure wheel, the strip of material wrapping said feeding rolls and being drivingly engageable thereby in response to tension produced in the strip of material be engagement of the pressure wheel and driven roll therewith. Feeding of the strips of material is also accomplished by a power driven unwinding reel for each strip of material and by a dancer associated with each unwinding reel and engaged by the strip of material discharged therefrom, the dancer being operable to control the speed of its associated unwinding reel in response to the tension in the strip of material as produced by the pressure wheel and feeding rolls.

Each cut-off device includes a driven anvil roll engaging one side of a strip of material, and a cutting roll having a cutting blade engageable with the opposite side of the strip of material. Movement of the cutting roll is regulated by an escapement which is releasable by an actuator operated by the control means.

The severing device comprises a driven roll having a cutting blade extending across all of the parallel lanes, with movement of this cutting roll being controlled by a single revolution clutch operable by the control means.

The control means for regulating the operation of the feeding, cut-off and severing devices includes a pulse generator which produces successive current pulses, each indicative of the passage of an increment of length of backing web through the pressing station, and means for counting these pulses. Programmable means enable the selection of a pulse count representative of a desired length of backing web for a finished product, and the selection for each lane of pulse count values corresponding to the desired start and stop locations of a strip material in each lane along the desired length of backing web material. Output means operate the feeding, cut-off and severing devices in response to inputs derived from said counting and programmable means.

Other features and advantages of the invention will appear from the description to follow of the representative embodiment thereof disclosed in the accompanying drawings.

DESCRIPTION OF THE DRAWINGS

FIG. 5 is a side elevation, taken as indicated by the line 5—5 of FIG. 2, showing the gear train of the apparatus;

FIG. 6 is an enlarged side elevation showing details of a cut-off station in the apparatus of FIG. 2;

FIG. 7 is a sectional elevation taken on the line 7—7 of FIG. 6;

FIG. 8 is an enlarged side elevation showing details of a selective feed staion in the apparatus of FIG. 2;

DESCRIPTION OF THE PREFERRED EMBODIMENT

Figures 1, 2, 3, 4:
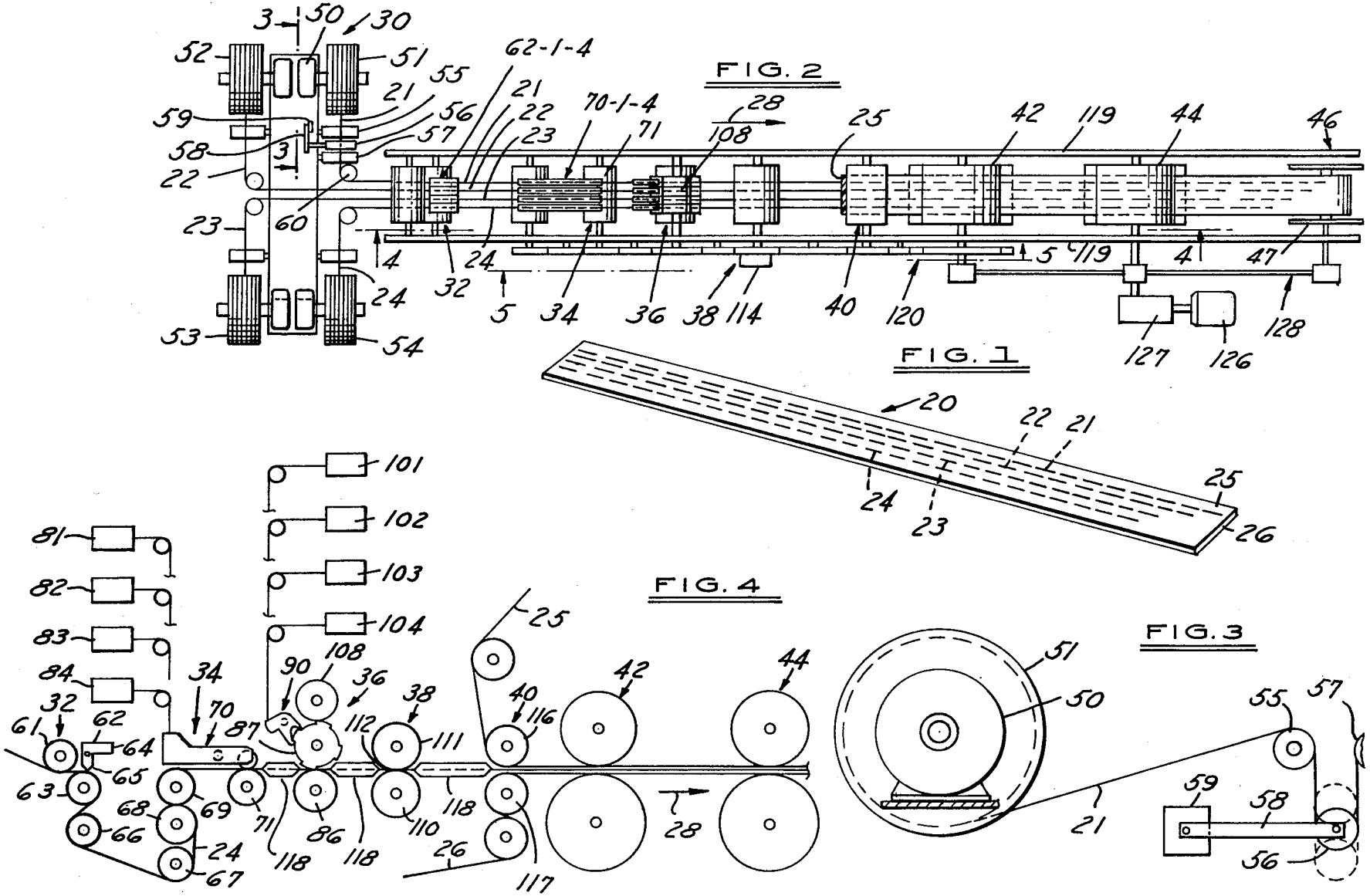
FIG. 1 is a perspective view of a representative article—a wiring harness—made by the apparatus of the invention.
FIG. 2 is a plan view of apparatus, constructed in accordance with the invention, for the manufacture of the article shown in FIG. 1.
FIG. 3 is a sectional side elevation on an enlarged scale taken as indicated by the line 3—3 of FIG. 2.
FIG. 4 is a sectional side elevation taken as indicated by the line 4—4 of FIG. 2.

A representative article 20 produced by the apparatus of the invention is shown in FIG. 1 and consists of an electrical wiring harness having strips of copper conductor 21, 22, 23 and 24 applied between upper and lower backing webs 25 and 26 of mylar. The strips 21–24 extend in a plurality of parallel lanes spaced transversely and extending longitudinally of the backing webs, and the length of the strip in each of the lanes is different from that of the strips in the other lanes. This product will be understood to be representative only of the products that can be manufactured with the apparatus of the invention, as will appear more fully below. The apparatus is not limited in use to any particular material for the backing web or to the strips applied thereto or to the product produced; the number of lanes of strip material can be increased or decreased as desired; and, the length of strip material in each lane can be controlled as desired so that each lane may contain a single strip or a plurality of strips, spaced longitudinally of the lane.

FIGS. 2-4 show the principal components of the apparatus of the invention, which is designed to continuously produce the product 20. Movement of the strip material 21-24 and backing webs 25 and 26 through the apparatus takes place in the direction of the arrow 28. The strips 21-24 are fed to the apparatus from an unwinding station 30, shown at the left of FIG. 2 and pass successively through an anti-backup station 32, a feeding station 34, a selective cutting station 36, a severing station 38, and to a pressing station 40 where the backing webs 25 and 26 are applied. Then the strips and backing webs are passed through successive heating and ironing stations 42 and 44 to a winding station 46 equipped with a reel 47 on which the product is wound. These various stations will be further described below.

The unwinding station 30 and the feeding station 34 operate in conjunction to provide means for feeding the strips 21-24 to the pressing station 40. At the unwinding station 30, a supply of each of the strips 21-24 is carried on individual unwinding reels 51-54, respectively, with each reel being individually driven by its own separate motor 50. FIG. 3 illustrates the reel 51 for the strip 21 which passes from the reel over a guide roller 55, under a dancer roller 56 and over a second guide roller 57. The dancer roller 56 is carried by a pivoted arm 58 which operates a potentiometer 59 for controlling the speed of the motor 50 driving the reel 51. As the dancer roller 56 moves upward from the lowermost, or zero speed position shown in FIG. 3 in response to tension in the strip 21, the speed of the motor 50 and the unwinding reel 51 driven thereby progressively increases. This dancer-potentiometer control is duplicated for each of the other reels 52-54. Each of the strips 21-24 passes from its respective guide roller 57 around a vertically mounted guide roller 60, arranged so that each strip is directed into one of a plurality of parallel lanes spaced transversely and extending longitudinally of the apparatus, as shown in FIG. 2.

These lanes will be referred to as Nos. 1-4, corresponding to the strips 21-24, respectively. At the anti-backup station 32, each of the strips 21-24 passes under a grooved guide roller 61 (FIG. 4) and between an anit-backup pawl 62 and a guide roller 63, there being a pawl 62 for each of the lanes 1-4. Each pawl 62 is mounted on a pivot and has a counterweight portion 64 acting to urge a nose portion 65 of the pawl into engagement with its respective strip—for example the strip 24 shown in FIG. 4—at a point just beyond a vertical centerline extending through the axis of the roller 63. Hence any reverse movement of the strip will result in it being jammed between the nose 65 of the pawl 62 and the roller 63. The pawls 62 are designated 62-1-4 in FIG. 2.

From the anti-backup station 32, the strips 21-24 pass over guide rollers 66 and 67 (FIG. 4) and a pair of power driven feeding rolls 63 and 69 located at the entrance to the feeding station 34. Each strip then passes over a power driven roll 71 engageable with the underside of the strips and a selectively operable feeding device 70 having a pressure wheel 72 engageable with the opposite side of the strip, there being one of the feeding devices 70 for each of the lanes 1-4, as indicated by the reference 70-1-4 in FIG. 2. One of the feeding devices 70 is shown in detail in FIG. 8.

The pressure wheel 72 of each of the feeding devices 70 is mounted for movement toward and away from the driven roll 71 by means including a lever 74 which is supported on a pivot 75 carried by suitable frame structure 76 of the apparatus. A tension spring 78 is connected to the pressure wheel supporting end of the lever 74, as shown in FIG. 8, and the opposite end 79 of each lever 74 is connected by a cable 80 to one of the actuators 81-84 shown in FIG. 4. These actuators are preferably solenoids, and when each is energized, the cable 80 connected thereto moves the pressure wheel 72 of the feeding device 70 toward the driven roll 71 and into engagement with the strip of material, such as the strip 24 shown in FIG. 8. This produces tension in the strip of material so engaged and causes it to wrap more tightly around the feeding rolls 68 and 69, thereby advancing the strip of material toward the pressing station 40 and producing tension in the strip of material on the upstream side of the feeding station 34, which tension in turn acts upon the dancer roller 56 and the individual driving motor for the unwinding reel of the strip of material.

The selective feeding station 34 is followed by the selective cut-off station 36 which is illustrated in FIGS. 6 and 7. Each of the strips of material 21-24 passes over a driven anvil roll 86 and under a selectively operable cutting roll 87 having a plurality of cutting blades 88 engageable with the strip. One of the cutting rolls 87 is provided for each of the lanes, and it will be understood that the cutting device shown in FIGS. 6 and 7 and described below is duplicated for each lane. Movement of the cutting roll 87 is normally prevented by escapement means 90 comprising a pawl 91 mounted on a pivot 92 carried by frame structure 93 and having a pair of projections 94 and 95 spaced circumferentially relative to the axis of the cutting roll 87.

These projections 94 and 95 are respectively engageable with leading and trailing detents 96 and 97 spaced circumferentially of the cutting roll 87 and formed by the ends of each of a plurality of driving lobes 98 on the cutting roll 87. each driving lobe having a leading detent 95 engageable by the projection 94 on the pawl 91 and a trailing detent 97 engageable by the other projection 95 on the pawl 91. As shown in FIG. 6, a tension spring 99 biases the pawl 91 so that the projection 94 thereof normally engages one of the leading detents 96, thus preventing rotary motion of the cutting roll 87. A cable 100 connects each pawl 91 to one of the actuators 101-104 (FIG. 4), these actuators preferably being solenoids. A pivoted antibackup pawl 106 is mounted generally diametrically opposite to the escapement pawl 91 and is normally urged into engagement with one of the trailing detents 97 as shown in FIG. 6; and a drive assist roll 108, preferably of rubber, is mounted above the cutting roll 87 and is power driven.

Operation of one of the solenoids 101-104 causes the escapement pawl 91 connected thereto to pivot in a clockwise direction as shown in FIG. 6, thus disengaging the projection 94 from a leading detent 96 on the cutting roll 87 and bringing the projection 94 into engagement with the trailing detent 97, imparting rotary movement to the cutting roll 87. This movement is continued by the frictional engagement of a pair of oppositely disposed driving lobes 98 with the driven anvil roll 86 and drive assist roll 108 and brings one of the cutting blades 88 into engagement with the strip 24, severing it. Energization of any one of the solenoids 101-104 is momentary so that when an opposed pair of driving lobes 98 on the cutting roll pass out of engagement with the periphery of the anvil roller 86 and drive assist roller 108, the pawl 91 has returned to a position where the projection 94 thereof is engageable by the next leading detent 96 on the cutting roll 87. Thus the movement of the cutting roll 87 is arrested, and reverse movement thereof is prevented by the action of the anti-backup pawl 106.

At the severing station 38, each strip passes over a driven anvil roll 110 (FIG. 4) and under a cutting roller 111, provided with a cutting blade 112, and connected to the drive train shown in FIG. 5 by a solenoid operated, single revolution clutch 114. Operation of the clutch causes the cutting roller 111 to be rotated and results in the cutting blade thereof severing any strip in each of the lanes 1–4.

The strips then enter the pressing station 40 where the upper backing web 25 passes under a pressing roll 116 (FIG. 4) and the lower backing web 26 passes over a pressing roll 117. A suitable heat and pressure sensitive adhesive coating is applied to the opposed faces of the webs 25 and 26 and the pressing rolls 116 and 117 are heated to initiate the bonding of this adhesive. Further perfection of the adhesive bond is accomplished by the successive heating station 42 and ironing station 44 which also employ heated rolls, and the finished product is wound on the reel 47. Alternatively, the finished product may be cut to length, if desired. The heating and ironing stations 42 and 44 follow conventional practice in the manufacture of laminate products, and further description thereof is not believed necessary.

Since the strips 21–24 are each fed to the pressing station 40 as a result of the action of the feeding means 70, suitable guides 118 (FIG. 4) are employed between the feeding station 34 and cut-off station 36, between the cut-off station 36 and severing station 38, and between the severing station 38 and pressing station 40. These guides encapsulate each strip and insure the travel thereof in the proper lane between these stations.

Figure 9:
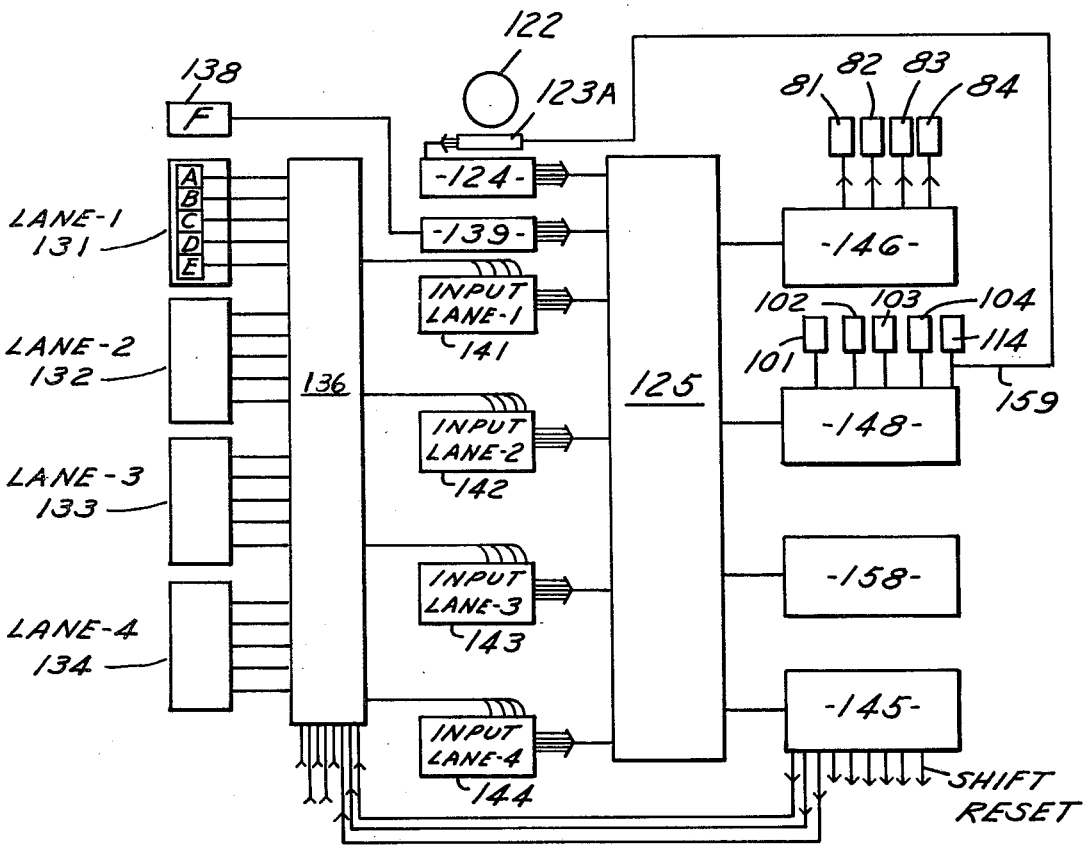
FIG. 9 is a block diagram of a control system for the apparatus of the invention.

As shown in FIG. 2, the various components of the apparatus described above are suitably mounted between a pair of side frames 119 and are driven by drive means 120 comprising a gear train which is shown in detail in FIG. 5. In this view, the gear directly associated with each of the rolls described above is identified by the same reference number primed. These gears are keyed to the shaft on which their associated roll is mounted except for the gear 87' which merely transmits motion from the gear 86' connected with the anvil roller 86 to the gear 108' connected to the drive assist roller 108. The cutting rolls 87 are not driven by the gear 87', but only by operation of the escapement pawl 91 and by the frictional drive imparted to the driving lobes 98 by the anvil roller 86 and drive assist roller 108. Likewise, the gear 111' is connected to the cutting roller 111 through the solenoid operated single revolution clutch 114, as previously described. A pulse generator 122 is driven by a gear 123 from the gear 117' connected to the pressing roll 117. This pulse generator forms part of control means for regulating the operation of the feeding, cut-off and severing devices in response to movement of a predetermined length of backing web. Such control means are schematically illustrated in FIG. 9.

The pulse generator 122 produces a certain number of pulses for each revolution of the pressing roll 117 so that each pulse represents a given increment of length of the moving backing web 26. These pulses are registered by a counter 123A and are supplied through an input module 124 as control signals to a programmable sequencer 125, such as Texas Instruments, Inc., Model No. 5 TI-1023. Selector means 131–134 are provided for each of the lanes 1–4 respectively, and in the form of control means illustrated in FIG. 9 each of these selector means includes a plurality of manually operable selectors labelled A through E. For example, each of the selectors A–E is a thumb wheel switch which can be set to a numerical value corresponding to a certain length of backing web. The selectors A, C and E are operable to select desired starting points for the application of strip material to the backing web, and the selectors B and D are operable to select stopping points. The selectors are individually operable so that a single length of strip material can be applied to the backing web for a given lane, or multiple lengths of strip material can be applied in a given lane.

The settings of the selectors for each of the lanes are registered in a shift register 136 to which step pulses from a sequencer output module 145 are fed and which controls input modules 141–144 for each of the lanes 1–4 respectively.

Selector means 138 includes a thumb wheel switch selector F for setting a numerical value representative of a desired length of backing web for a finished product, and the setting thereof is fed through an input module 139 to the sequencer 125.

An output module 146 driven by the sequencer 125 is operable to energize each of the solenoids 81–84 at the feeding station 34 in accordance with the setting of the selectors A, C and E of the selector means 131–134 for each of the lanes. A second output module 148 is driven by the sequencer 125 and is operable to control each of the solenoids 101-104 of the cut-off devices at the cut-off station 36. Each output signal from the module 148 to energize the solenoids 101-104 is also used to deenergize the corresponding feeding station solenoids 81–84 so that when a strip in any lane is cut at the cut-off station 36, the feeding of that strip is stopped at the feeding station 34. The output module 148 also controls the operation of the single revolution clutch 114 at the severing station 38 in accordance with the setting of the selector F, and simultaneously applies a reset signal to the counter 123A through a connection 159.

The control means of FIG. 9 may alternatively employ a commercially available programmable controller 158 (such as Texas Instruments, Inc., Model No. 5 TI-2000) for supplying the necessary input information to the sequencer 125, instead of the manually operable selector means 131–134 and 138, the shift register 136, and the input modules 139 and 141–144. As will be apparent to those skilled in the computer art, the selection of the proper controller 158 will depend upon the number of functions involved, which will in turn be determined by the number of lanes provided in the apparatus and the number of control variables desired for each lane.

Figure 10:
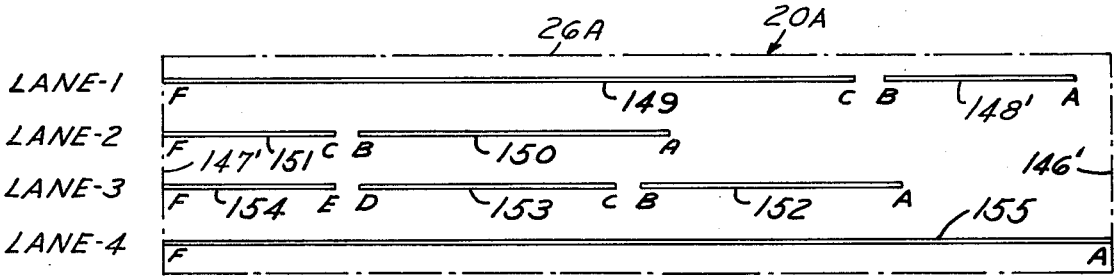
FIG. 10 is a schematic plan view of a representative article which illustrates the operation of the control system of FIG. 9.

The operation of the control means is further illustrated by the sample product 20A shown in FIG. 10 and having a leading end 146' and a trailing end 147' spaced apart by some desired length of backing web 26A. This length is determined by the setting of the selector F of the programmable means 138. Lane 1 of this product has two lengths of strip material 148' and 149 applied thereto as determined by the settings of the selectors A, B and C for that lane; lane 2 has two strips 150 and 151 applied thereto at different locations from the strips in lane 1, as determined by the settings of the selectors A, B and C for lane 2; lane 3 has three strips of material, 152, 153 and 154 applied thereto as determined by the settings of the lane 3 selectors A, B, C, D and E; and lane 4 has a single strip 155 applied thereto and extending throughout the length of the product.

In determining the settings of the selectors A–E, compensation must be provided for the time required to operate the device controlled by each selector. For example, in the case of the selectors A, C and E which control the solenoids 81–84 of the feeding devices, a certain interval will elapse between the time one of these solenoids is energized and the time that the strip engaged by the feeding device of that solenoid is moving at line speed. This time interval can be translated into the distance covered by the moving web during that interval and the setting of the selector adjusted to advance the timing of its control function accordingly. The same applies to the selectors B and D of each lane which control the operation of the selective cut-off device and to the operation of the selector F which controls the single revolution clutch 114. These adjustment factors can be determined by measurement.

I claim:

1. Apparatus for applying a plurality of strips of material to a backing web in a plurality of parallel lanes spaced transversely and extending longitudinally of the backing web, comprising a pressing station having means for continuously moving the backing web therethrough;

means for feeding the strips of material to the pressing station for application to the backing web, said feeding means including a selectively operable feeding device for each of said lanes;

cut-off means located between said feeding devices and said pressing station, said cut-off means including a selectively operable cut-off device for each of said lanes;

and control means responsive to the movement of a predetermined length of the backing web for regulating the operation of said feeding and cut-off devices whereby said strips of material are applied to the backing web in desired lengths along said lanes.

2. Apparatus as defined in claim 1 further comprising selectively operable severing means located between said cut-off devices and said pressing station for simultaneously severing any strips of material in said lanes, said control means regulating the operation of said severing means in response to the movement of said predetermined length of the backing web, and deactivating all of said feeding devices simultaneously with the operation of said severing means.

3. Apparatus as defined in claim 1 wherein said feeding devices each comprise a driven roll engageable with one side of a strip of material, a pressure wheel engageable with the opposite side thereof, means mounting the pressure wheel for movement toward and away from the driven roll, an actuator connected to said mounting means and operable by said control means for moving the pressure wheel toward the driven roll and into engagement with the strip of material, and power driven feeding rolls on the upstream side of said pressure wheel, the strip of material wrapping said feeding rolls and being drivingly engageable thereby in response to tension produced in the strip of material by engagement of the pressure wheel and driven roll therewith.

4. Apparatus as defined in claim 3 wherein said means for feeding the strips of material further includes a power driven unwinding reel for each strip of material, a dancer associated with each unwinding reel and engaged by the strip of material discharged therefrom, said dancer being operable to control the speed of its associated unwinding reel in response to the tension of the strip of material.

5. Apparatus as defined in claim 1 wherein said cutoff device each comprises a driven anvil roll engageable with one side of a strip of material, a cutting roll having a cutting blade engageable with the opposite side of the strip, escapement means for preventing movement of said cutting roll, and an actuator connected to said escapement means and operable by said control means for releasing said escapement means and initiating a cutting movement of said cutting roll.

6. Apparatus as defined in claim 5 wherein said escapement means comprises a pivoted pawl having a pair of projections spaced circumferentially of said cutting roll, and a pair of circumferentially spaced detents on said cutting roll engageable by said projections to stop and initiate movement of said cutting roll.

7. Apparatus as defined in claim 5 wherein said escapement means comprises a pivoted pawl having a pair of projections spaced circumferentially relative to said cutting roll, said pawl being pivotally movable by said actuator, a plurality of circumferentially spaced driving lobes on said cutting roll, each driving lobe having a leading detent engageable by one of said projections for stopping movement of the cutting roll and a trailing detent engageable by the other of said projections for initiating movement of the cutting roll in response to pivotal movement of said pawl by said actuator, and a cutting blade provided on said cutting roll adjacent each of said driving lobes.

8. Apparatus as defined in claim 1 wherein said control means includes means for generating successive current pulses each indicative of the passage of an increment of length of backing web through the pressing station, means for counting said pulses, programmable means for selecting pulse count values corresponding to the desired start and stop locations of strip material in each lane, and output means for operating said feeding and cut-off devices in response to inputs derived from said counting and programmable means.

9. Apparatus as defined in claim 8 wherein said programmable means includes means for setting a pulse count representative of a desired length of backing web for a finished product, and said output means includes means for operating said severing device.

10. Apparatus as defined in claim 9 wherein said programmable means comprises for each lane a plurality of manual selectors operable to set desired starting and stopping locatio ıs for the strip material in such lane, and a manually operable selector for setting the desired length of backing web.

* * * * *